US009900951B1

(12) United States Patent
Lee et al.

(10) Patent No.: US 9,900,951 B1
(45) Date of Patent: Feb. 20, 2018

(54) LAMP HAVING THE THERMAL SENSING ELEMENTS DISPOSED AT OPTIMAL POSITIONS AND THERMAL CONTROLLING METHOD THEREOF

(71) Applicant: ELEMENTS PERFORMANCE MATERIALS LIMITED, Kaohsiung (TW)

(72) Inventors: Tsung-Lung Lee, Kaohsiung (TW); Kuo-Sung Huang, Kaohsiung (TW)

(73) Assignee: ELEMENTS PERFORMANCE MATERIALS LIMITED, Kaohsiung (TW)

( * ) Notice: Subject to any disclaimer, the term of this patent is extended or adjusted under 35 U.S.C. 154(b) by 0 days.

(21) Appl. No.: 15/648,506

(22) Filed: Jul. 13, 2017

(51) Int. Cl.

| | |
|---|---|
| ***H01J 61/52*** | (2006.01) |
| ***H05B 33/08*** | (2006.01) |
| ***F21K 9/232*** | (2016.01) |
| ***F21V 29/77*** | (2015.01) |
| ***F21K 9/238*** | (2016.01) |
| *F21Y 115/10* | (2016.01) |

(52) U.S. Cl.
CPC ..... *H05B 33/0848* (2013.01); *F21K 9/232* (2016.08); *F21K 9/238* (2016.08); *F21V 29/773* (2015.01); *F21Y 2115/10* (2016.08)

(58) Field of Classification Search
CPC ..... H05B 33/08; H05B 33/0848; H05B 33/0803; H05B 37/02; F21K 9/232; F21K 9/238; F21V 29/773; H01J 61/52; H01J 61/53
See application file for complete search history.

(56) References Cited

U.S. PATENT DOCUMENTS

| | | | | |
|---|---|---|---|---|
| 9,188,307 | B2 * | 11/2015 | Casper | F21V 23/02 |
| 2009/0160344 | A1 * | 6/2009 | Hsu | F21K 9/00 315/117 |
| 2010/0244648 | A1 * | 9/2010 | Yoo | F21V 29/507 313/46 |
| 2011/0285308 | A1 * | 11/2011 | Crystal | H05B 33/0815 315/287 |
| 2012/0098434 | A1 * | 4/2012 | Sondericker, III | H05B 33/0803 315/113 |

* cited by examiner

*Primary Examiner* — Thai Pham
(74) *Attorney, Agent, or Firm* — Li & Cai Intellectual Property (USA) Office

(57) ABSTRACT

A lamp having the thermal sensing elements disposed at optimal positions includes a heat sink, a light-emitting module and a power supply module. The heat sink includes a plurality of heat dissipating fins, and a heat dissipating channel formed between each two of the plurality of heat dissipating fins, therefore forms an accommodating space. The power supply module is disposed in the accommodating space. The power supply module includes a conductive base and a controlling module. The power source module and thermal sensitive elements are disposed at the lamp cold zone. First thermal sensing elements of the controlling module are disposed at the lamp heat zone to sense the first operating temperature. A processing unit of the control module lowers the output power of the power source module to the light-emitting module when the first operating temperature is greater than or equal to a first critical operating temperature.

30 Claims, 14 Drawing Sheets

LAMP HAVING THE THERMAL SENSING ELEMENTS DISPOSED AT OPTIMAL POSITIONS AND THERMAL CONTROLLING METHOD THEREOF

BACKGROUND OF THE INVENTION

1. Field of the Invention

The instant disclosure relates to a lamp; in particular, to a lamp having the thermal sensing elements disposed at optimal positions and a thermal controlling method thereof.

2. Description of Related Art

Light emitting diodes have been placed at high value in recent years, especially the high-brightness light emitting diodes (HB LEDs) for which the demand is greatly increased and this has set off a frenzy in the field. High-brightness light emitting diodes have the advantages of energy saving, long product life, high durability and high brightness and short response time compared to conventional incandescent bulbs. Currently, high-brightness light emitting diodes are not only applied to general illumination, commercial illumination, vehicle illumination, outdoor advertising billboards and traffic information signs, but also have become a strongly integrated item in a variety of fields of LCD backlight modules, smart phones and digital camera flashlight modules along with the improvement of consumer electronics.

Most of electric energy will be converted to thermal energy and only a small amount of electric energy will be converted to light during the usage of light emitting diodes. High high-brightness light emitting diodes consume most of the electric energy among them. For this reason, the electric current for light emitting diodes must be carefully designed.

Light emitting diodes have rated values for limited temperature in operating mode. If light emitting diodes are used under high temperature for a long time without sufficient heat dissipation, the light emitting diodes will accelerate aging therefore reducing illumination efficiency and shortening life. The dissipation issue is very important for light emitting diodes applied to light bulbs, especially when applied to hermetic lamps or insulator lamps. For instance, the overheating temperatures inside the lamp due to insufficient dissipation will result in not only the damage of the light emitting diodes, but also the damage of related electronic components, especially a capacitor, of the power supply inside the lamp. Hence, it is one of the major topics of the field to effectively control the internal temperature inside the light emitting diode lamp so as to avoid damage of the internal components.

Therefore, there is a need of a solution which overcomes the above disadvantages.

SUMMARY OF THE INVENTION

The object of the instant disclosure is to provide a lamp with a sensing element disposed at an optimal position and the sensing controlling method thereof, which can immediately monitor the internal temperature of the lamps by at least a first thermal sensing element (or at least a second thermal sensing element) disposed in the lamp, and then can immediately adjust the output power of a power source module. This is to avoid and solve the lamp damage problem caused by overheating, and relatively promote the product life of the lamp.

In order to achieve the aforementioned objects, according to an embodiment of the instant disclosure, a lamp having thermal sensing elements disposed at optimal positions in which a lamp cold zone and a lamp heat zone are defined is provided, the lamp comprises: a heat sink, a light-emitting module, a power supply module and a controlling module. The heat sink comprises a plurality of heat dissipating fins spaced apart from each other and a connecting part, wherein a heat dissipating channel is formed between each two of the plurality of heat dissipating fins, and the plurality of heat dissipating fins surround a central axis of the heat sink to form an accommodating space. The light-emitting module comprises a substrate and at least one light-emitting unit, wherein the substrate is disposed at the connecting part of the heat sink, and the at least one light-emitting unit is disposed on the substrate. The power supply module is disposed in the accommodating space, wherein a central channel is formed between the power supply module and the plurality of heat dissipating fins, the central channel communicates with the heat dissipating channel, and the power supply module comprises a conductive base and a power source module. The conductive base is disposed away from the substrate for connecting to an external power supply. The power source module is electrically connected to the conductive base and the light-emitting module, wherein the power source module comprises at least one thermal sensitive element disposed at the lamp cold zone. The controlling module comprises at least one first thermal sensing element and a processing unit, wherein the at least one first thermal sensing element is disposed adjacently to the substrate in the lamp heat zone, the at least one first thermal sensing element may sense a first operating temperature, and the processing unit is electrically connected to the power source module and the at least one first thermal sensing element; and the processing unit may lower an output power of the power source module to the light-emitting module when the first operating temperature is greater than or equal to a first critical operating temperature of the light-emitting module. The lamp cold zone has a first cold zone boundary and a second cold zone boundary, the lamp heat zone has a first heat zone boundary and a second heat zone boundary; the first heat zone boundary is coplanar with a surface of the substrate on which the at least one light-emitting unit is disposed, the first cold zone boundary is at the bottom of the conductive base, and a distance between the first cold zone boundary and the first heat zone boundary is an internal element distance; a first distance between the second heat zone boundary and the first heat zone boundary is one-third of the internal element distance, and a second distance between the second cold zone boundary and the first cold zone boundary is one-third of the internal element distance.

In order to achieve the aforementioned objects, according to an embodiment of the instant disclosure, a lamp having thermal sensing elements disposed at optimal positions in which a lamp cold zone and a lamp heat zone are defined is also provided, the lamp comprises: a heat sink, a light-emitting module, a power supply module and a controlling module. The heat sink comprises a plurality of heat dissipating fins spaced apart from each other and a connecting part, wherein a heat dissipating channel is formed between each two of the plurality of heat dissipating fins, and the plurality of heat dissipating fins surround a central axis of the heat sink to form an accommodating space. The light-emitting module comprises a substrate and at least one light-emitting unit, wherein the substrate is disposed at the connecting part of the heat sink, and the at least one light-emitting unit is disposed on the substrate. The power supply module is disposed in the accommodating space, wherein a central channel is formed between the power supply module and the plurality of heat dissipating fins, the central channel communicates with the heat dissipating channel, and the power supply module comprises a conductive base and a power source module. The conductive base is disposed away from the substrate for connecting to an external power supply. The power source module is electrically connected to the conductive base and the light-emitting module, wherein the power source module comprises at least one thermal sensitive element disposed at the lamp cold zone. The controlling module comprises at least one first thermal sensing element and a processing unit, wherein the at least one first thermal sensing element is disposed adjacently to the substrate in the lamp heat zone, the at least one first thermal sensing element may sense a first operating temperature, and the processing unit is electrically connected to the power source module and the at least one first thermal sensing element; and the processing unit may lower an output power of the power source module to the light-emitting module when the first operating temperature is greater than or equal to a first critical operating temperature of the light-emitting module. Wherein, the lamp cold zone has a first cold zone boundary and a second cold zone boundary, the lamp heat zone has a first heat zone boundary and a second heat zone boundary; the first heat zone boundary is a safety distance toward to the conductive base from a surface of the substrate on which the at least one light-emitting element is disposed, the first cold zone boundary is at the bottom of the conductive base, and a distance between the first cold zone boundary and the first heat zone boundary is an internal element distance; a first distance between the second heat zone boundary and the first heat zone boundary is one-third of the internal element, and a second distance between the second cold zone boundary and the first cold zone boundary is one-third of the internal element distance.

In order to achieve the aforementioned objects, according to an embodiment of the instant disclosure, a thermal controlling method for lamp is provided, which comprises the following steps: step S1: providing a lamp comprising a heat sink, a light-emitting module and a power supply module, wherein the heat sink comprises a plurality of heat dissipating fins spaced apart from each other, a heat dissipating channel is formed between each two of the plurality of heat dissipating fins, and the plurality of heat dissipating fins surround a central axis of the heat sink to form an accommodating space, and the light-emitting module is disposed at one end of the heat sink. Step S2: disposing the power supply module into the accommodating space to form a central channel between the power supply module and the plurality of heat dissipating fins, wherein central channel communicates with the heat dissipating channel, the power supply module comprises a controlling module and a power source module electrically connected to each other, the controlling module comprises at least one first thermal sensing element and a processing unit, the power source module comprises at least one thermal sensitive element away from the light-emitting module and disposed in a lamp cold zone of the lamp. Step S3: disposing the at least one first thermal sensing element adjacent to a substrate of the light-emitting module to make the at least one first thermal sensing element in a lamp heat zone of the lamp. Step S4: operating the lamp. Step S5: determining whether a first operating temperature of the at least one first thermal sensing element is greater than or equal to a first critical operating temperature of the light-emitting module by utilizing the processing unit. Step S6: utilizing the processing unit to lower an output power of the power source module to the light-emitting module after the processing unit has determined the first operating temperature is greater than or equal to the first critical operating temperature. The lamp cold zone has a first cold zone boundary and a second cold zone boundary, the lamp heat zone has a first heat zone boundary and a second heat zone boundary; the first heat zone boundary is coplanar with a surface of the substrate on which the at least one light-emitting unit is disposed, the first cold zone boundary is at the bottom of the conductive base, and a distance between the first cold zone boundary and the first heat zone boundary is an internal element distance; a first distance between the second heat zone boundary and the first heat zone boundary is one-third of the internal element distance, and a second distance between the second cold zone boundary and the first cold zone boundary is one-third of the internal element distance.

In order to achieve the aforementioned objects, according to an embodiment of the instant disclosure, a thermal controlling method for lamp is also provided, which comprises following steps. Step S1: providing a lamp comprising a heat sink, a light-emitting module and a power supply module, wherein the heat sink comprises a plurality of heat dissipating fins spaced apart from each other, a heat dissipating channel is formed between each two of the plurality of heat dissipating fins, and the plurality of heat dissipating fins surround a central axis of the heat sink to form an accommodating space, and the light-emitting module is disposed at one end of the heat sink. Step S2: disposing the power supply module into the accommodating space to form a central channel between the power supply module and the plurality of heat dissipating fins, wherein central channel communicates with the heat dissipating channel, the power supply module comprises a controlling module and a power source module electrically connected to each other, the controlling module comprises at least one first thermal sensing element and a processing unit, the power source module comprises at least one thermal sensitive element away from the light-emitting module and disposed in a lamp cold zone of the lamp. Step S3: disposing the at least one first thermal sensing element adjacent to a substrate of the light-emitting module to make the at least one first thermal sensing element in a lamp heat zone of the lamp. Step S4: operating the lamp. Step S5: determining whether a first operating temperature of the at least one first thermal sensing element is greater than or equal to a first critical operating temperature of the light-emitting module by utilizing the processing unit. Step S6: utilizing the processing unit to lower an output power of the power source module to the light-emitting module after the processing unit has determined the first operating temperature is greater than or equal to the first critical operating temperature. The lamp cold zone has a first cold zone boundary and a second cold zone boundary, the lamp heat zone has a first heat zone boundary and a second heat zone boundary; the first heat zone boundary is a safety distance from a surface of the substrate on which the at least one light-emitting unit is disposed, the first cold zone boundary is at the bottom of the conductive base, and a distance between the first cold zone boundary and the first heat zone boundary is an internal element distance; a first distance between the second heat zone boundary and the first heat zone boundary is one-third of the internal element distance, and a second distance between the second cold zone boundary and the first cold zone boundary is one-third of the internal element distance.

A lamp having thermal sensing element disposed at optimal position and the sensing controlling method thereof provided by the instant disclosure have advantages that the instant disclosure can individually sense temperatures of the substrate of the light-emitting module and of the thermal sensitive elements of the lamps by at least a first thermal sensing element (or at least a second thermal sensing element) disposed in the lamp, thereby determining if the light-emitting module and each of thermal sensitive element are overheating, then immediately adjusting the output power of a power source module. This is to avoid and solve the lamp damage problem caused by over heat.

In order to further the understanding regarding the instant disclosure, the following embodiments are provided along with illustrations to facilitate the disclosure of the instant disclosure.

DETAILED DESCRIPTION OF THE PREFERRED EMBODIMENTS

Figure 1:
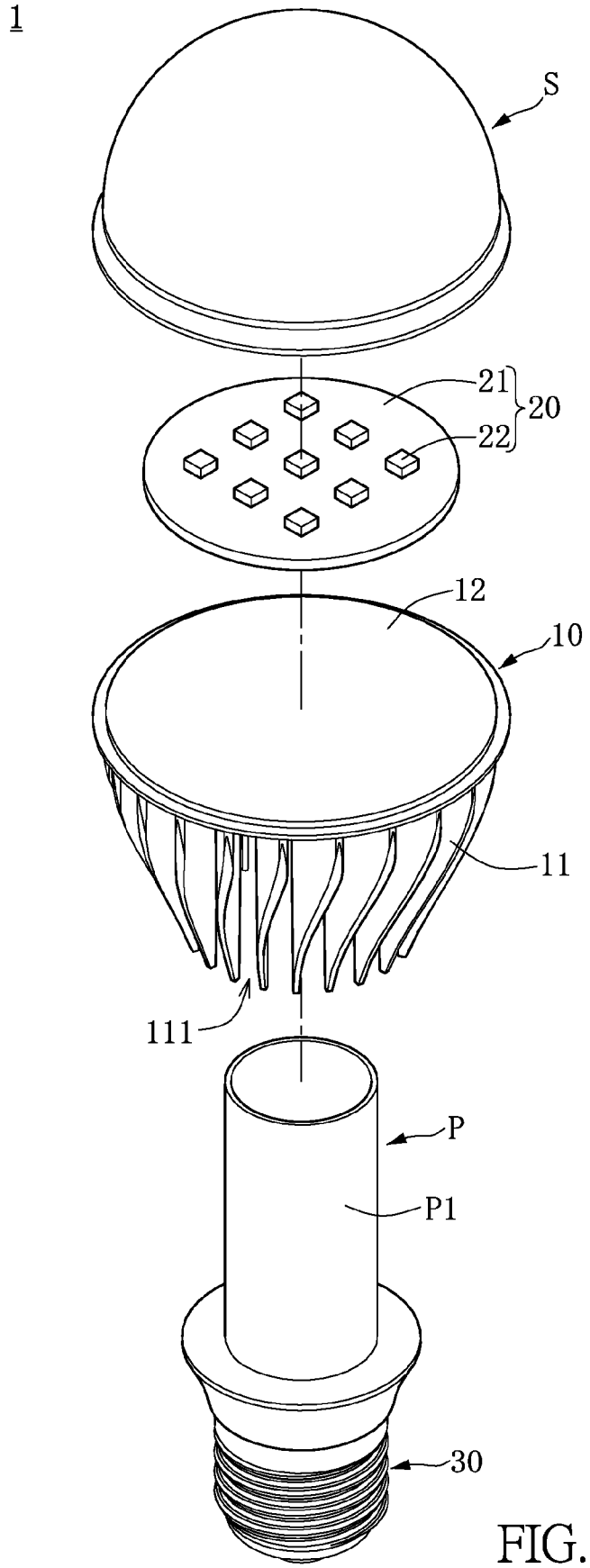
FIGS. 1 and 2 show exploded diagrams of a lamp having the thermal sensing elements disposed at optimal positions according to a first embodiment of the instant disclosure.
Figure 2:
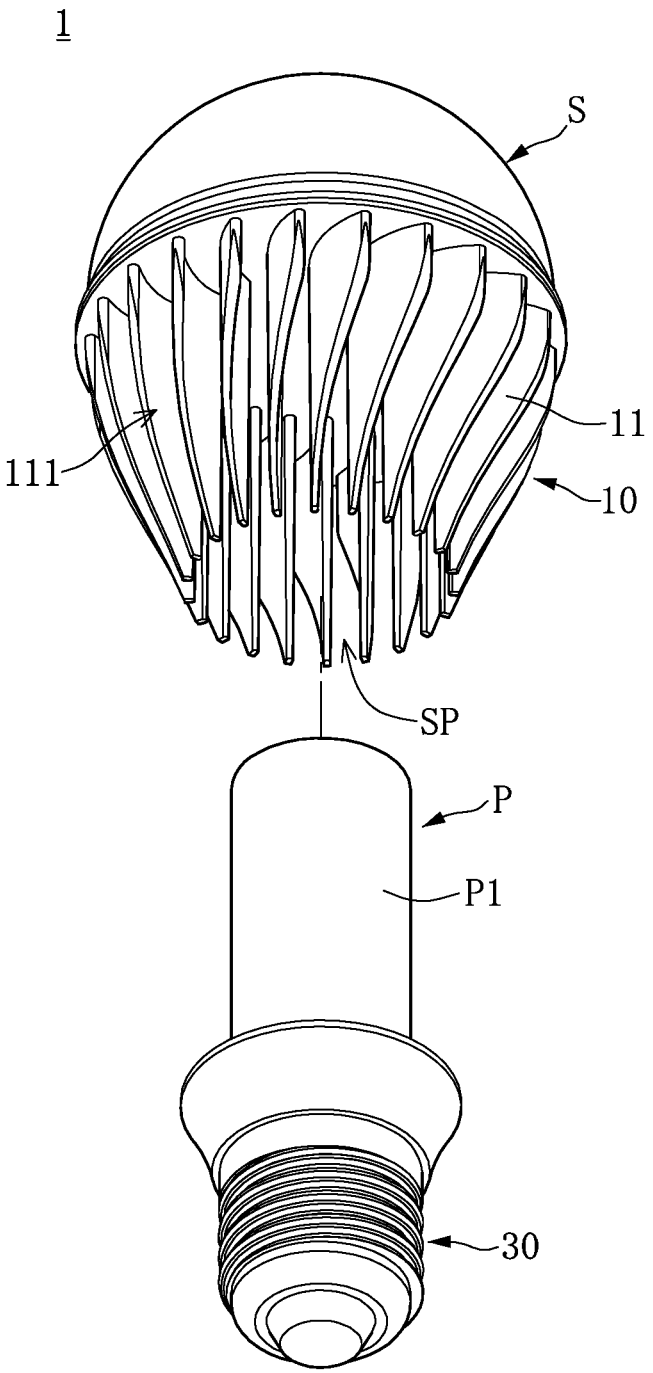

The aforementioned illustrations and following detailed descriptions are exemplary for the purpose of further explaining the scope of the instant disclosure. Other objectives and advantages related to the instant disclosure will be illustrated in the subsequent descriptions and appended drawings.

First Embodiment

Please refer to FIGS. 1 to 4, which are diagrams of a lamp having the thermal sensing elements disposed at optimal positions according to a first embodiment of the instant disclosure. As shown in the figures, a lamp 1 having the thermal sensing elements disposed at optimal positions includes a heat sink 10, a light-emitting module 20, a power supply module P and a cover S. The power supply module P includes a conductive base 40 and a controlling module 50. The heat sink 10 includes a plurality of heat dissipating fins 11, a heat dissipating channel 111 is formed between each two of the plurality of heat dissipating fins 11; the plurality of heat dissipating fins 11 surround a central axis of the heat sink 10 to form an accommodating space SP. The light-emitting module 20 comprises a substrate 21 and multiple light-emitting units 22, and these light-emitting units 22 are disposed on the substrate 21, and the substrate 21 is disposed at the connecting part 12 of the heat sink 10. Preferably, each light-emitting unit 22 could be light emitting diodes (LED) or high-brightness light emitting diodes (HB LED).

The power supply module P is disposed in the accommodating space SP, a central channel 112 is formed between the power supply module P and the plurality of heat dissipating fins 11, and the central channel 112 communicates the heat dissipating channels 111. Specifically, the power supply module P has a hollow tube P1, the conductive base 30 is disposed at one end of the hollow tube P1, and the power source module 40 and the controlling module 50 are disposed in the hollow tube P1. The power supply module P is disposed in the accommodating space SP, therefore the hollow tube P1 is completed surrounded by the heat dissipating fins 11, and the central channel 112 is formed between the hollow tube P1 and the heat dissipating fins 11. That is, only the conductive base 30 is exposed outside the heat sink 10, and the remainder are disposed in the heat sink 10 and surrounded by the heat dissipating fins 11, while the power supply module P is disposed in the accommodating space SP. Wherein, the power supply module P is disposed in the accommodating space SP, while the other end of the hollow tube P1 opposite the end provided with the conductive 30 is adjacent to or connected to a connecting part 12 of the heat sink 10. In other words, the other end of the hollow tube P1 without the conductive base 30 corresponds to the position adjacent to the light-emitting module 20 while the power supply module P is disposed in the accommodating space SP.

The power source module 40 is disposed in the hollow tube P1, and the power source module 40 includes at least one thermal sensitive element 41 (e.g. various capacitors, IC chips, etc.), and the at least one thermal sensitive element is disposed adjacent to the conductive base 30 and in a lamp cold zone A. In one actual application, the conductive base 30 could be but is not limited to a screw thread base or pin base. The power source module 40 further comprises DC-AC conversion units, a voltage regulating unit, a voltage transforming unit, and a line filter, etc.

The controlling module 50 is disposed in the hollow tube P1, and the controlling module 50 includes a first thermal sensing element 51 and a processing unit (not shown, such as a microprocessor). The first thermal sensing element 51 is disposed adjacent to the connecting part 12 of the heat sink 10 to sense a first operating temperature T1 of the nearby area thereof. That is, the first thermal sensing element 51 is disposed adjacent to the substrate 21 of the light-emitting module 20 to sense the first operating temperature T1 near the substrate 21. It is noted that the first thermal sensing element 51 could be a safety distance (not shown, e.g. 0~7 mm) from the substrate 21. In another application, the first thermal sensing element 51 could be disposed at one side of the substrate 21 on which the light-emitting units 22 are disposed. In other words, the first thermal sensing element 51 could be disposed on the upper side or the lower side of the substrate 21 depending on the need. The processing unit is electrically connected to the power source module 40 and the first thermal sensing element 51. The processing unit adjusts correspondingly the light-emitting module 20 and the power source module 40 according to the temperature information sensed by the first thermal sensing element 51.

The processing unit of the controlling module 50 is used to determine whether the sensed first operating temperature T1 is greater than a first critical operating temperature TS1 of the light-emitting module 20 or not. When the process unit of the controlling module 50 determines that the first operating temperature T1 is greater than or equal to the first critical operating temperature TS1, the process unit of the controlling module 50 will lower the output power of the power source module 40 to the light-emitting module 20 to stop temperatures of each light-emitting unit 22 of the light-emitting module 20 and each thermal sensitive element 41 of the power source module 40 from keeping rising. This is to effectively prevent the internal parts of the lamp 1 from being broken due to high temperatures. Therefore, a variety of thermal sensitive elements 41 of the power source module 40 could be effectively protected, especially the electrolyte of electrolytic capacitors could be prevented from leaking out due to the high temperature, and the product life of the light-emitting module 20 could be prolonged. The first thermal sensing element 51 could be a thermistor, a thermal diode or a thermal couple. In this embodiment, it could preferably be a positive temperature coefficient (PTC) thermistor, in which the resistance value and the ambient temperature are proportional.

Figure 4:
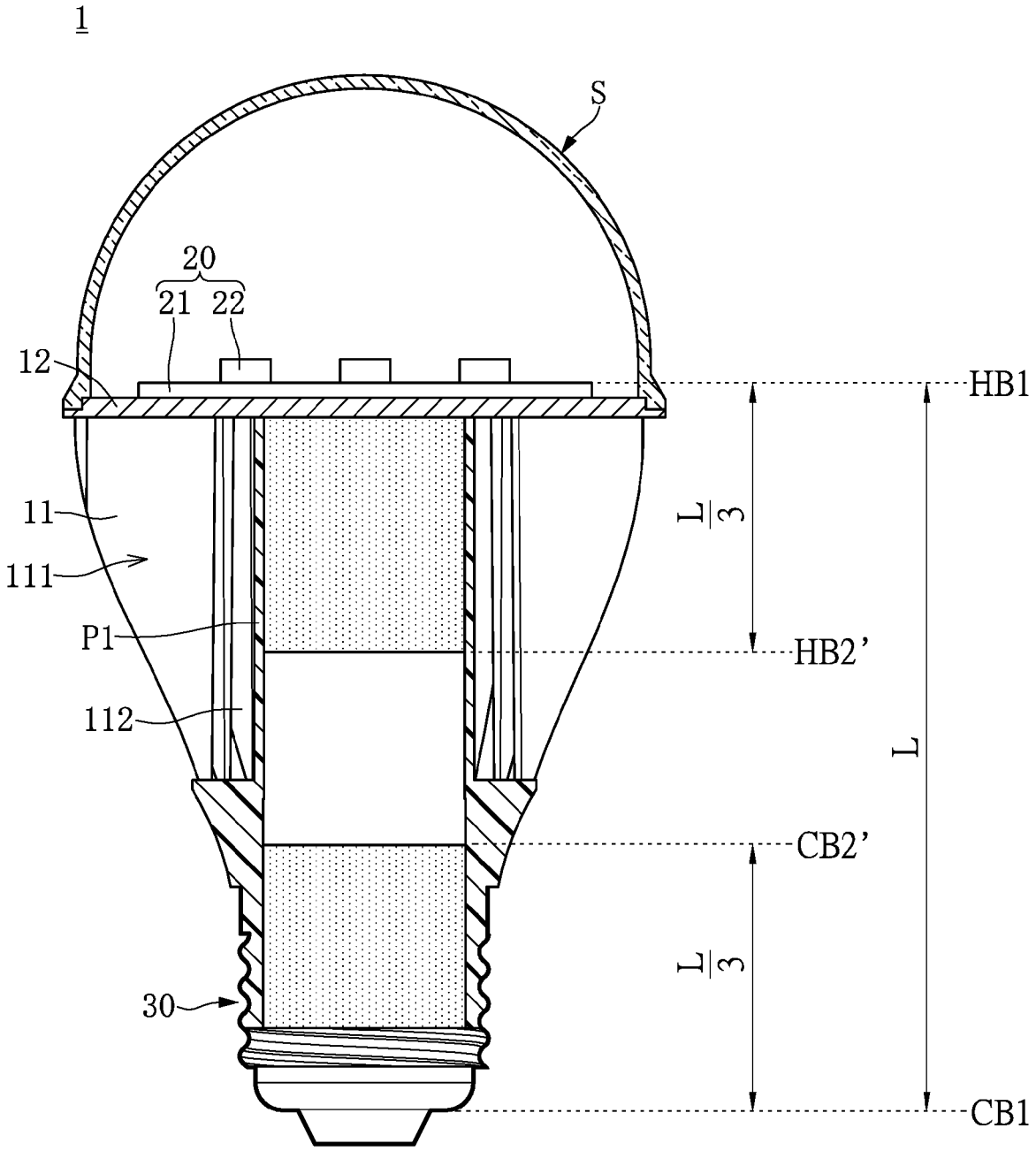
FIG. 4 shows a diagram of a lamp cold zone and a lamp heat zone of a lamp having the thermal sensing elements disposed at optimal positions according to a first embodiment of the instant disclosure.

Please refer to FIG. 4, regarding the aforementioned lamp cold zone A and lamp heat zone B, further said, the lamp cold zone A has a first cold zone boundary CB1 and a second cold zone CB2'; and the lamp heat zone B has a first heat zone boundary HB1 and a second heat zone boundary HB2'. The first heat zone boundary HB1 is coplanar with a surface of the substrate 21 on which the light-emitting units 22 are disposed, the first cold zone boundary CB1 is at the bottom of the conductive base 30, and a distance between the first heat zone boundary HB1 and the first cold zone boundary CB1 is an internal element distance L. A distance (a second distance) between the second cold zone boundary CB2' and the first cold zone boundary CB1 is one-third of the internal element distance L; and a distance (a first distance) between the second heat zone boundary HB2' and the first heat zone boundary HB1 is one-third of the internal element distance L. In other words, the second cold zone boundary CB2' and the second heat zone boundary HB2' will be differ according to different lengths of the lamp 1 in practical applications.

Take the commonly used 18 W, conductive base 30, E27 (or E26) A19 bulb for example, after use over a long time, the average temperature of the light-emitting module 20 is about 100° C. to 130° C. i.e. said lamp heat zone B, and the average temperature of the conductive base 30 is about 70° C. to 105° C., i.e. said lamp cold zone A. In other words, the temperature differences between the lamp heat zone B and the lamp cold zone A are up to 5 to 60 degrees, which means partial thermal sensitive element 41 disposed in the lamp heat zone B inside the LED bulb would be damaged due to high temperature after prolonged usage. Hence, the product life is relatively shortened. On the other hand, by disposing at least one first thermal sensing element 51 to determine internal operating temperatures of the lamp, by which the output power of the power source module 40 to the light-emitting module 20 is adjusted, prevents the light-emitting module 20 and each thermal sensitive element 41 from damage due to overheat. The following table shows experimental data of the actual temperatures of the instant disclosure and conventional lamp. It is shown that the lamp of the instant disclosure has lower operating temperature compared to the conventional one; this is to effectively protect each element inside the lamp from damage because of high temperatures.

| | Conventional lamp | Instant disclosure |
|---|---|---|
| Temperature of thermal sensitive element of power source module | 110° C. | 90° C. |
| Substrate temperature of light-emitting module | 140° C. | 120° C. |

Figure 3:
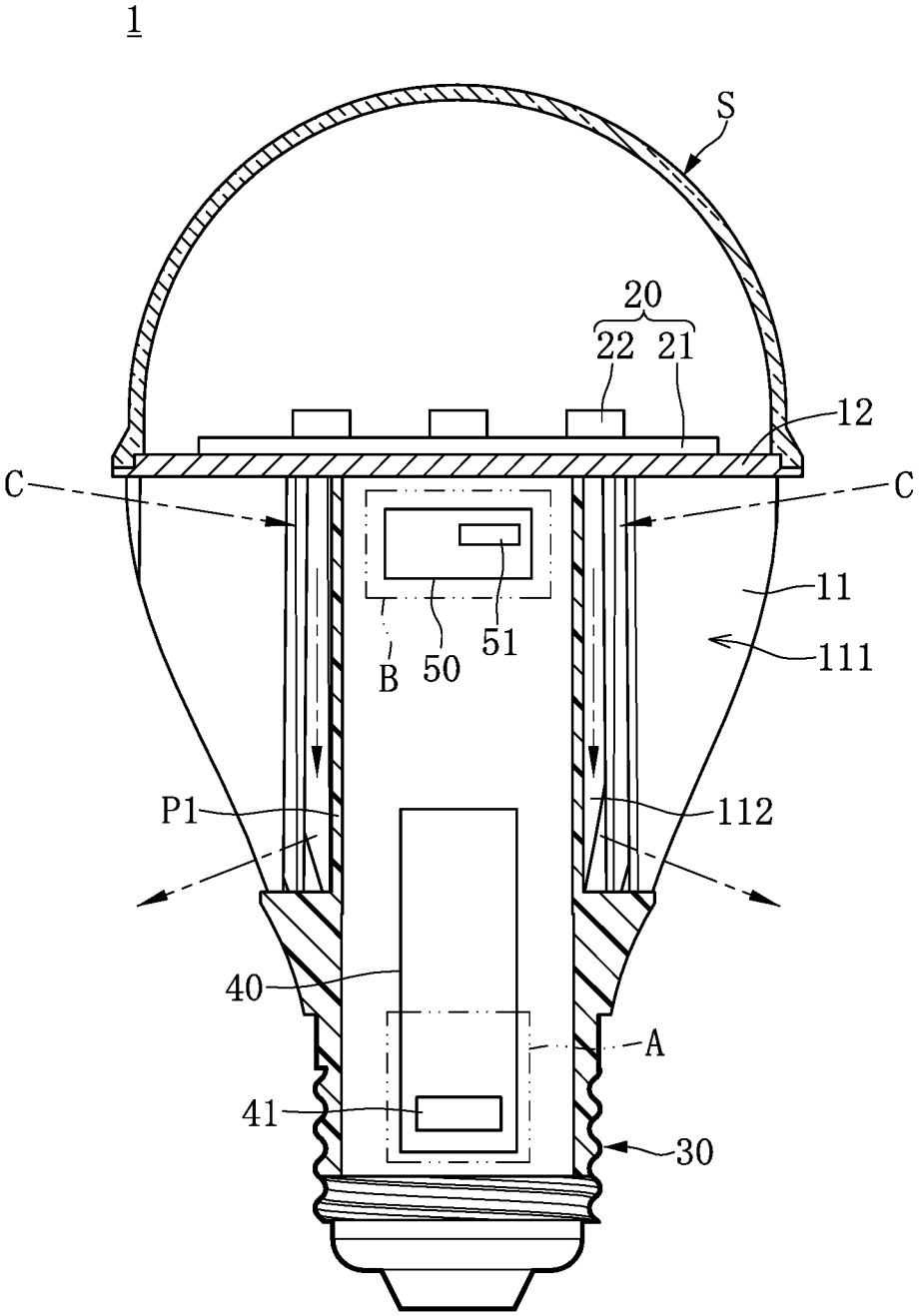
FIG. 3 shows a cross-sectional view of a lamp having the thermal sensing elements disposed at optimal positions according to a first embodiment of the instant disclosure.

Please refer to FIGS. 3 and 4, it is noted that the plurality of heat dissipating channel 111 and the central channel 112 form an airflow pathway C; when lamp 1 is operating, the relatively cold air outside the lamp enters the central channel 112 in the lamp 1 through the heat dissipating channels 111 near the lamp heat zone B and flow away from the heat dissipating channels 111 adjacent to the lamp cold zone A because of the temperature differences between the lamp heat zone B and the lamp cold zone A. In other words, according to the disposition of the heat dissipating channels 111 and the central channel 112, the external relatively cold air can flow through the lamp heat zone B of the lamp to help the lamp dissipate heat, thereby effectively protecting each element inside the lamp and preventing each element from damage due to high temperatures.

Second Embodiment

Figure 5:
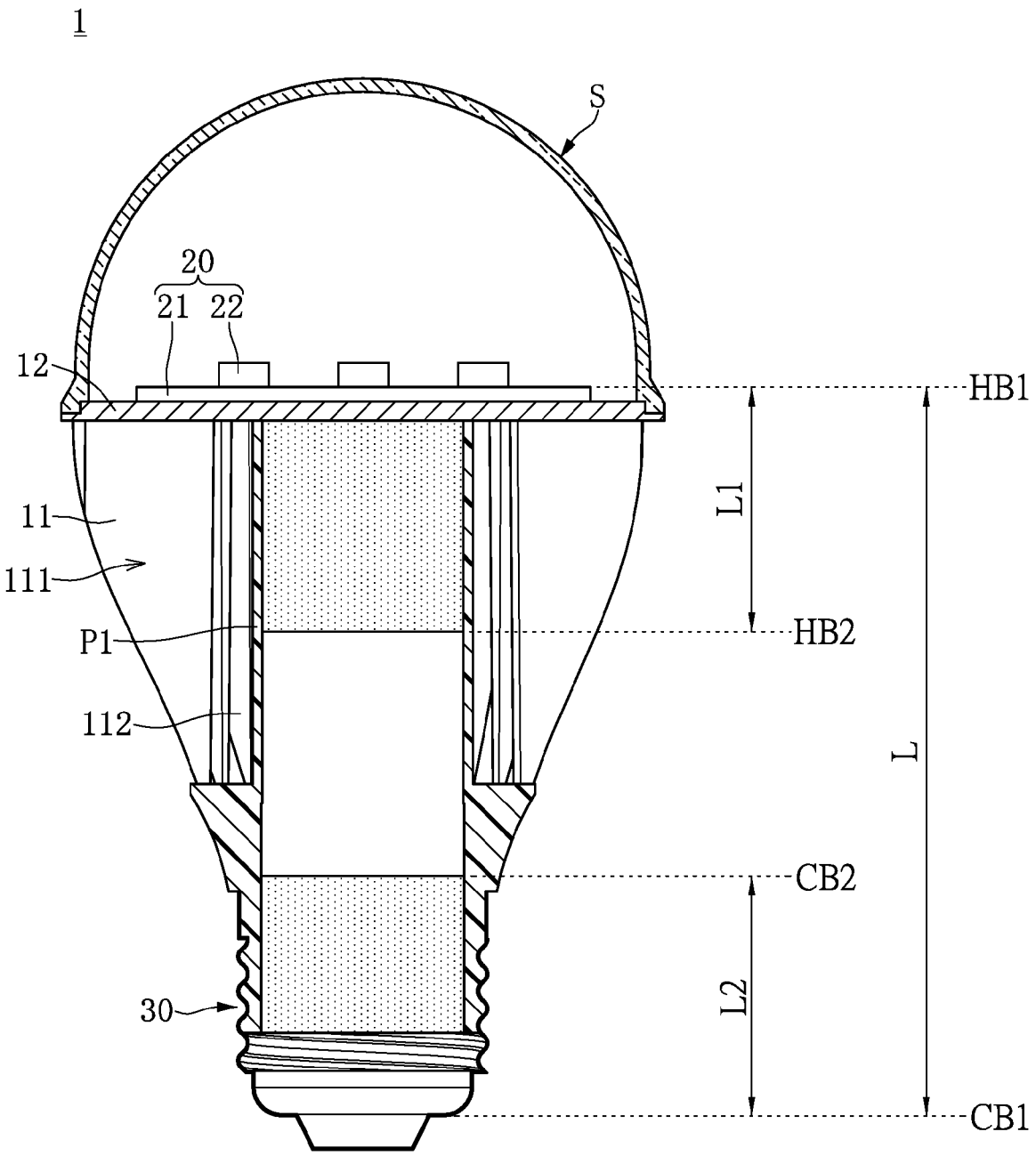
FIG. 5 shows a diagram of a lamp cold zone and a lamp heat zone of a lamp having the thermal sensing elements disposed at optimal positions according to a second embodiment of the instant disclosure.

Please refer to FIG. 5, which is a diagram of a second embodiment of the instant disclosure. In the practical application, the first distance L1 between the first heat zone boundary HB1 and the second heat zone boundary HB2 is within 0~20 mm, and the second distance L2 between the first cold zone boundary CB1 and the second cold zone boundary CB2 is within 0~20 mm. In addition, the distance between the first heat zone boundary HB1 and the substrate 21 of the light-emitting module 20 is 5~7 mm. The said boundary range of 0~20 mm is specifically for an E26 and E27 lamp; while the said boundary range could be determined according to sizes and lengths of lamps and not limited to the values provided by the instant disclosure.

Third Embodiment

Figure 6:
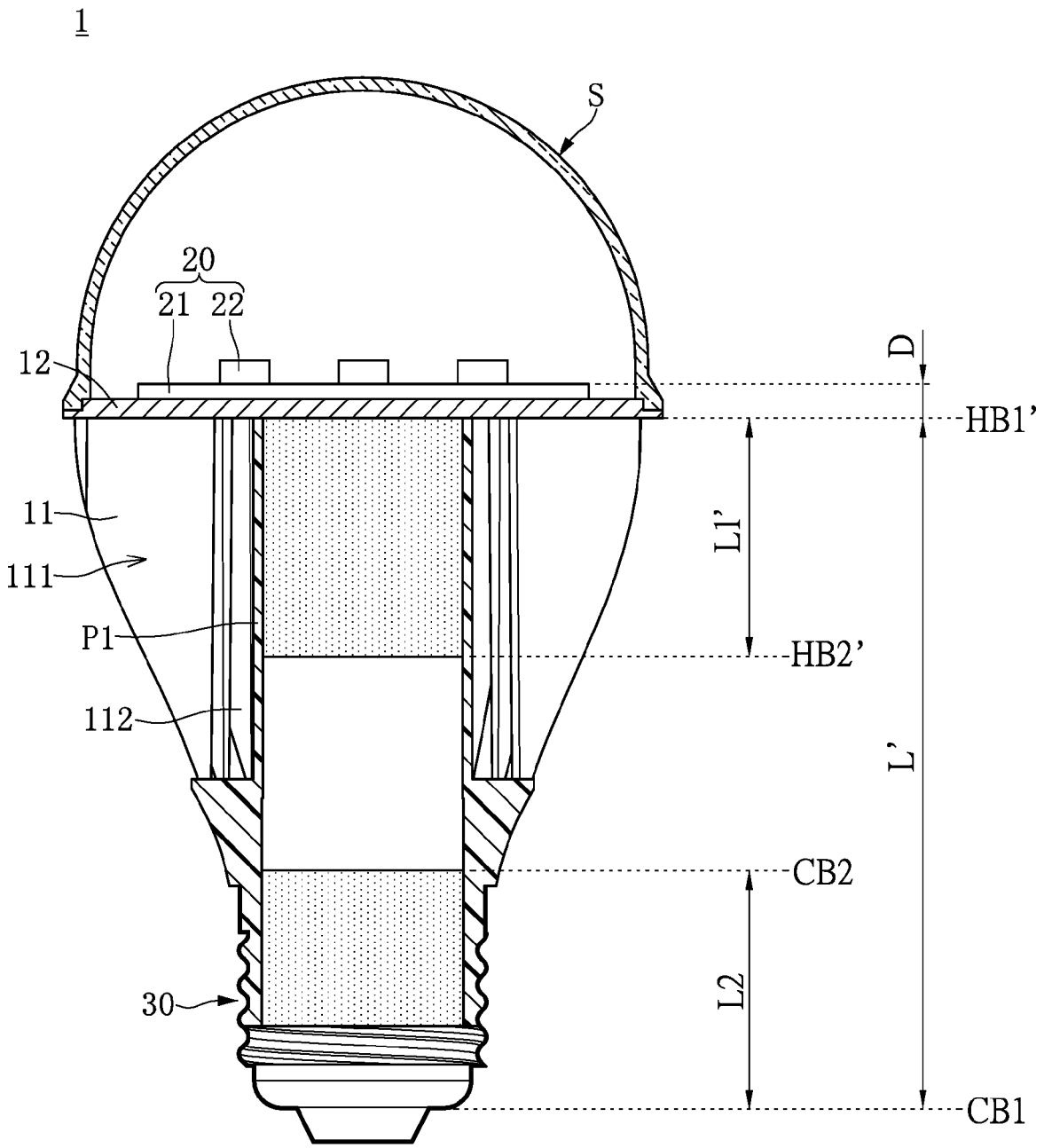
FIG. 6 shows a diagram of a lamp cold zone and a lamp heat zone of a lamp having the thermal sensing elements disposed at optimal positions according to a third embodiment of the instant disclosure.

Please refer to FIG. 6, which is a diagram of a third embodiment of the instant disclosure. The difference from the aforementioned embodiment is that the first heat zone boundary is defined by the position that is a safety distance D toward to the conductive base 30 from the surface of the substrate 21 of the light-emitting module 20 on which the light-emitting elements 22 are disposed to the first heat zone boundary HB1'. The first cold zone boundary CB1 is at the bottom of the conductive base 30, and a distance between the first heat zone boundary HB1' and the first cold zone boundary CB1' is an internal element distance L'. A distance (a second distance) between the second cold zone boundary CB2 and the first cold zone boundary CB1 is one-third of the internal element distance L; and a distance (a first distance) between the second heat zone boundary HB2' and the first heat zone boundary HB1 is one-third of the internal element distance L'. It is noted that the said safety distance is supposed to be 5~7 mm when using E27 or E26 lamp bulbs. Other safety distances D of relative kinds of lamp are all well known to those skilled in the art, and will not be described in detail herein.

Fourth Embodiment

Figure 7:
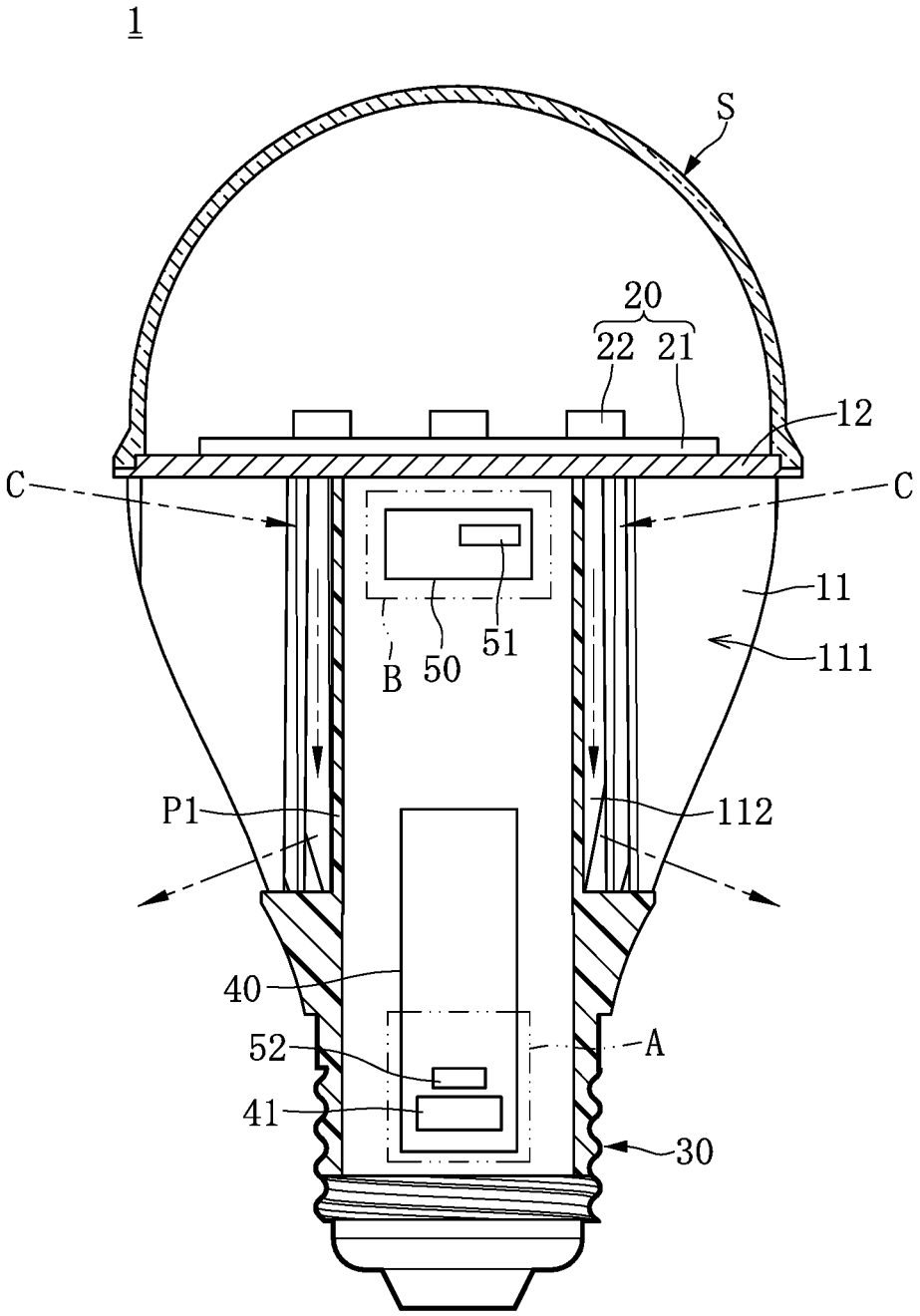
FIG. 7 shows a diagram of a lamp cold zone and a lamp heat zone of a lamp having the thermal sensing elements disposed at optimal positions according to a forth embodiment of the instant disclosure.

Please refer to FIG. 7, the significant difference between the present embodiment and aforementioned ones is that the controlling module 50 includes a first thermal sensing element 51, a second thermal sensing element 52 and a processing unit (not shown). The position of the first thermal sensing element 51 is the same as the aforementioned one, and will not be described further; the second thermal sensing element 52 is disposed adjacently to the thermal sensitive element 41 of the power source module 40, thereby measuring a second operating temperature TS2 of the thermal sensitive element 41. The processing unit of the controlling module 50 is electrically connected to the first thermal sensing element 51 and the second thermal sensing element 52; the processing unit of the controlling module 50 is able to determine whether the first operating temperature T1 is greater than or equal to the first critical operating temperature TS1 of the light-emitting module 20 and whether the second operating temperature T2 is greater than or equal to a second critical operating temperature TS2 of the thermal sensitive element 41; when the processing unit of the controlling module 50 judges that the first operating temperature T1 is greater than or equal to the first critical operating temperature TS1 or when the second operating temperature T2 is greater than or equal to the second critical operating temperature TS2, the processing unit of the controlling module 50 lowers the output power of the power source module 40 to the light-emitting module 20.

Specifically, when the lamp 1 is disposed in the relatively closed lampshade or space, the lamp 1 will be gradually heated under the long-term usage, therefore, the ambient temperature of the lampshade or the relatively closed space will be heated. That is, the temperature differences between the lamp cold zone A and the lamp heat zone B will be reduced. In other words, when the lamp 1 is disposed in the relatively closed lampshade or space, the temperature of the lamp cold zone A will be relatively high, and the thermal sensitive element 41 disposed in the lamp cold zone A will tend to be damaged due to the high temperature. Therefore, in the present embodiment, according to another exemplary aspect described, it could be the second thermal sensing element 52 disposed in the lamp 1 that monitors the second operating temperature T2 of each thermal sensitive element 41 immediately, and effectively prevents the aforementioned problem from happening. In the preferable application, the first critical operating temperature TS1 could be set to greater than the second critical operating temperature TS2. The following table shows experimental data of the actual temperatures of the instant disclosure and conventional lamp. It is shown that the instant disclosure can control the lamp to keep temperatures at relatively lower operating temperatures than conventional ones by disposing the thermal sensing element in the lamp heat zone; thereby every element in the lamp can be effectively protected.

| | Conventional lamp | Instant disclosure |
|---|---|---|
| Temperature of thermal sensitive element of power source module | 115° C. | 93° C. |
| Substrate temperature of light-emitting module | 143° C. | 122° C. |

Fifth Embodiment

Figure 8:
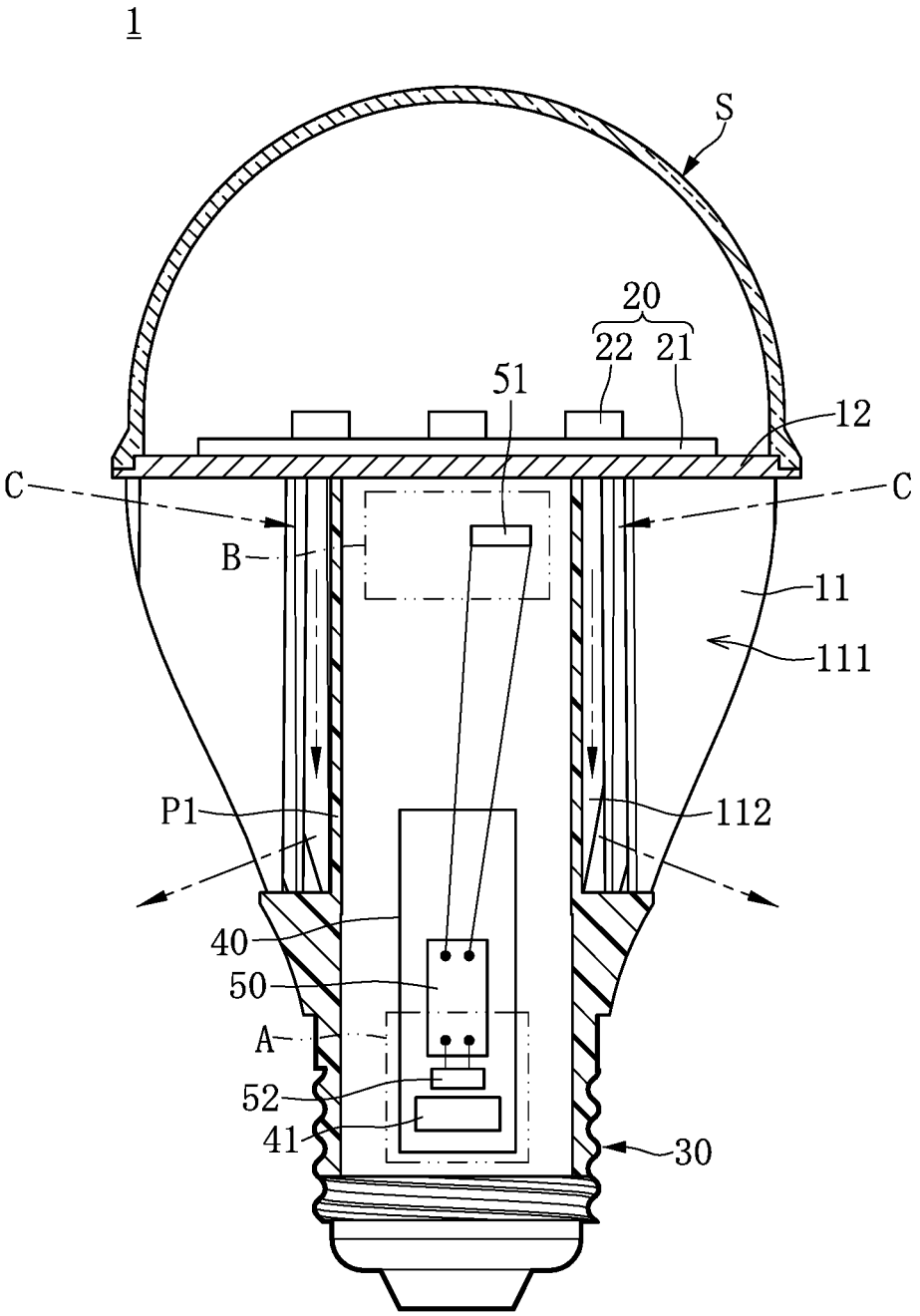
FIG. 8 shows a cross-sectional view of a lamp having the thermal sensing elements disposed at optimal positions according to a fifth embodiment of the instant disclosure.

Please refer to FIG. 8, the significant difference between the present embodiment and aforementioned ones is that the controlling module 50 is disposed on the circuit board of the power source module 40 disposed in the lamp cold zone A, and at least one first thermal sensing element 51 of the controlling module 50 is disposed in the lamp heat zone B by way of jump wires. The said way of jump wires could utilize two stronger steel wires covered by insulating layer to connect the first thermal sensing element 51. It is noted that, the figure of the present embodiment shows both the first thermal sensing element 51 and the second thermal sensing element 52, however in the practical application, only the first thermal sensing element 51 could be disposed, and it is not limited to the figure.

Sixth Embodiment

Figure 9:
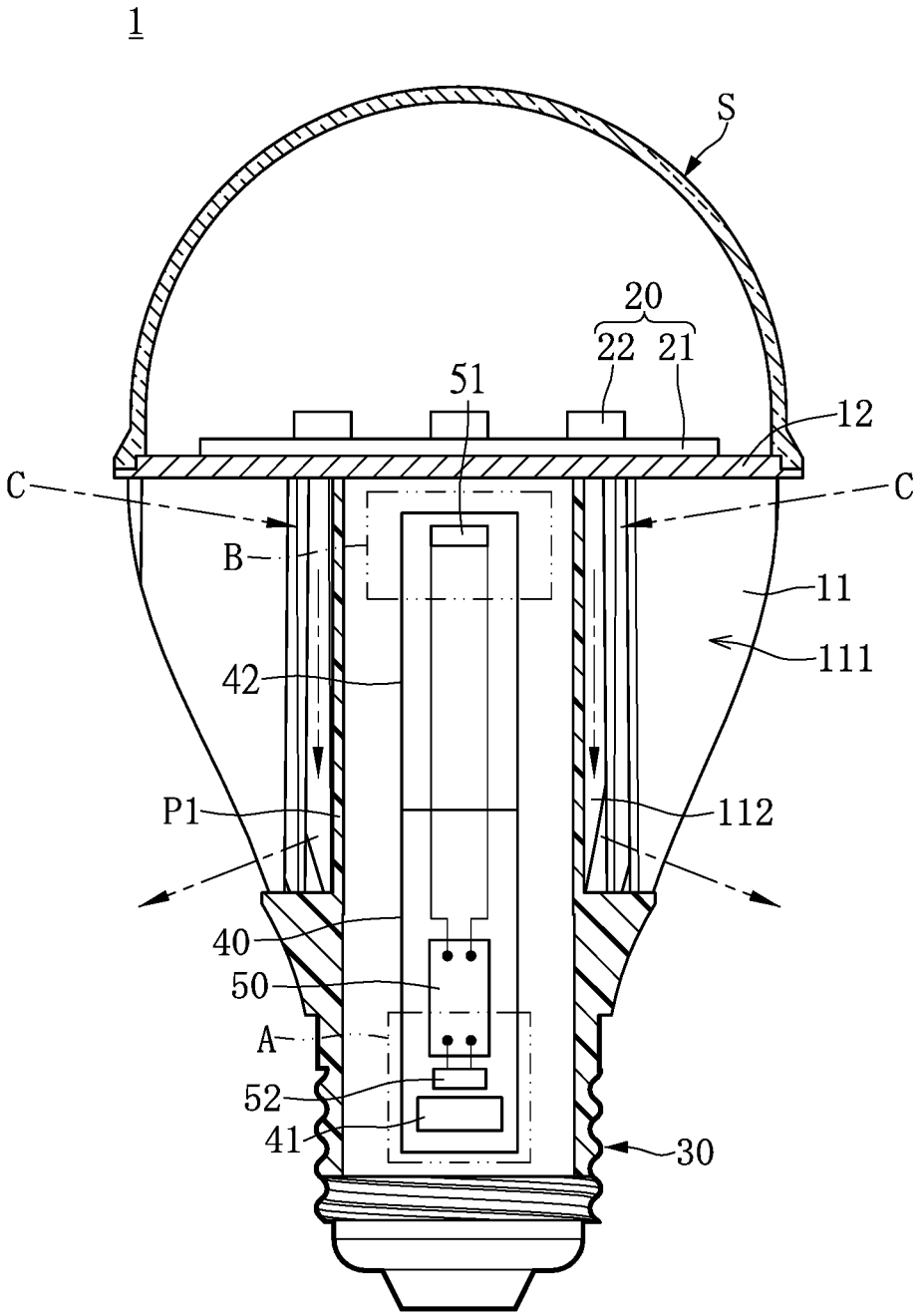
FIG. 9 shows a cross-sectional view of a lamp having the thermal sensing elements disposed at optimal positions according to a sixth embodiment of the instant disclosure.

Please refer to FIG. 9, the significant difference between the present embodiment and aforementioned ones is that the power source module 40 is disposed in the circuit board (such as, it could be an extending circuit board 42 extending toward the lamp heat zone B) of the lamp cold zone A, and the at least one first thermal sensing element 51 is disposed on the extending circuit board 42, therefore the first thermal sensing element 51 is disposed steadily in the lamp heat zone B and the wires connected to each first thermal sensing element 51 are connected to the controlling module 50 through the extending circuit board 42. In the practical application, it could be that the controlling module 50 and the at least one first thermal sensing element 51 thereof and the processing unit are disposed on the independent extending circuit board 42, and the independent extending circuit board 42 is connected to the circuit board of the power source module 40. It is noted that, the figure of the present embodiment shows both the first thermal sensing element 51 and the second thermal sensing element 52, however in practical application, it could only be the first thermal sensing element 51 disposed, and it is not limited to the figure.

Seventh Embodiment

Figure 10:
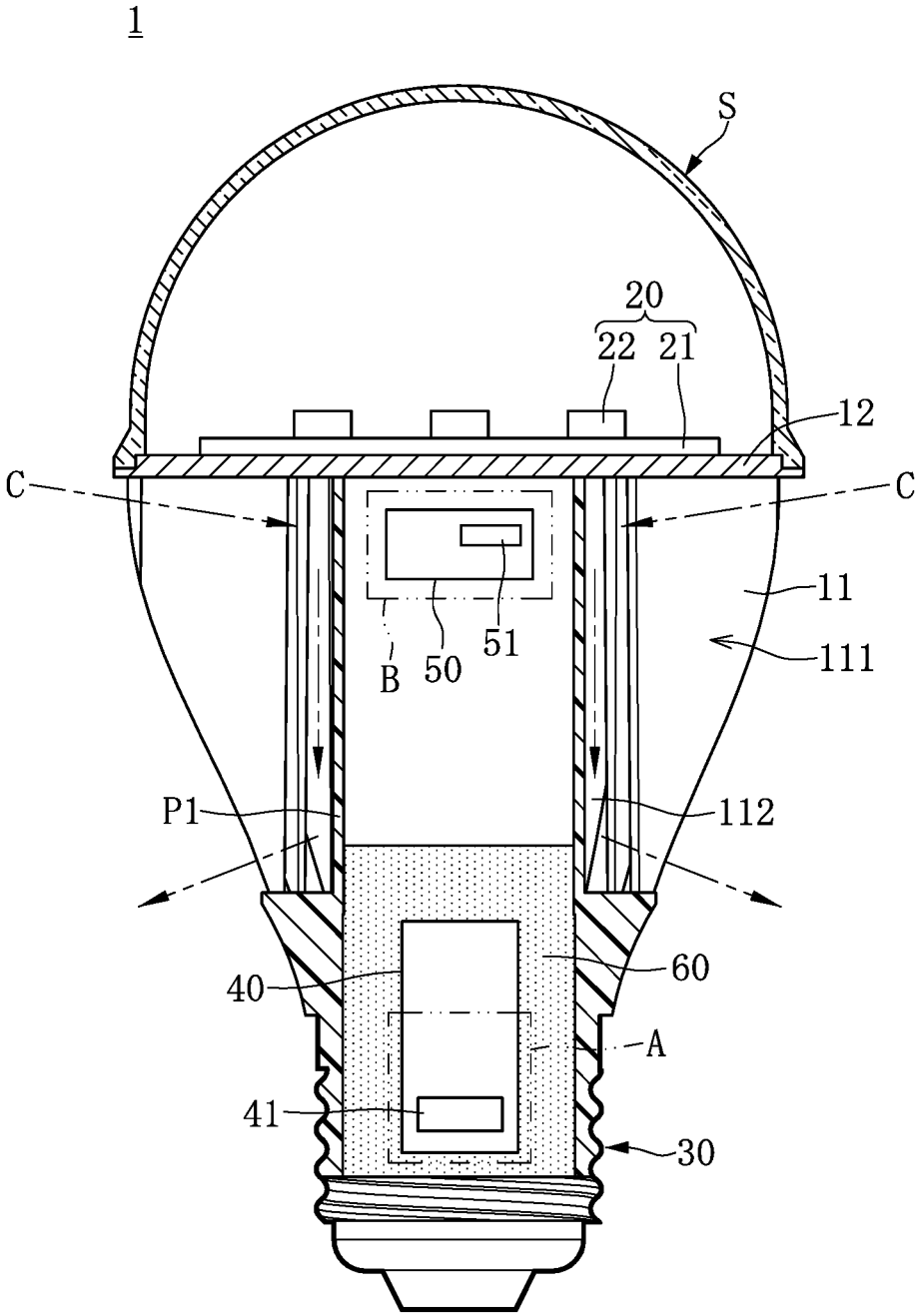
FIG. 10 shows a cross-sectional view of a lamp having the thermal sensing elements disposed at optimal positions according to a seventh embodiment of the instant disclosure.

Please refer to FIG. 10, the significant difference between the present embodiment and aforementioned ones is that the outside of the power source module 40 is encapsulated by a sealant 60, which could be insulating paste, thermally conductive paste or wax. In the practical application, the sealant 60 can be filled in the internal position of lamp 1 that corresponds to the power source module 40. In the practical application, the power source module 40 is deposed in the hollow tube P1 of the lamp 1, the thermal sensitive element 41 of the power source module 40 is at the lamp cold zone A, and then the sealant 60 is filled in the spacing between the power source module 40 and the hollow tube P1 by priming to completely cover the power source module 40. That is, the heat produced by the power source module 40 could be rapidly transmitted to the hollow tube P1 through the sealant 60, and then be dissipated out through the heat dissipating fins 11. On the other hand, the (most) heat produced by the light-emitting module 20 could be transmitted to the hollow tube P1 through the sealant 60 before being transmitted to the power source module 40. Hence the temperature surrounding the thermal sensitive element 41 of the power source module 40 could be relatively reduced. Briefly speaking, the present embodiment, by way of covering sealant 60 outside the power source module 40, the heat produced by the power source module 40 can be transmitted rapidly as can the partial heat produced by the light-emitting module 20, thereby the temperature surrounding the thermal sensitive element 41 of the power source module 40 is effectively reduced to achieve the aim of preventing the thermal sensitive element 41 from damage due to heat.

Eighth Embodiment

Figure 11:
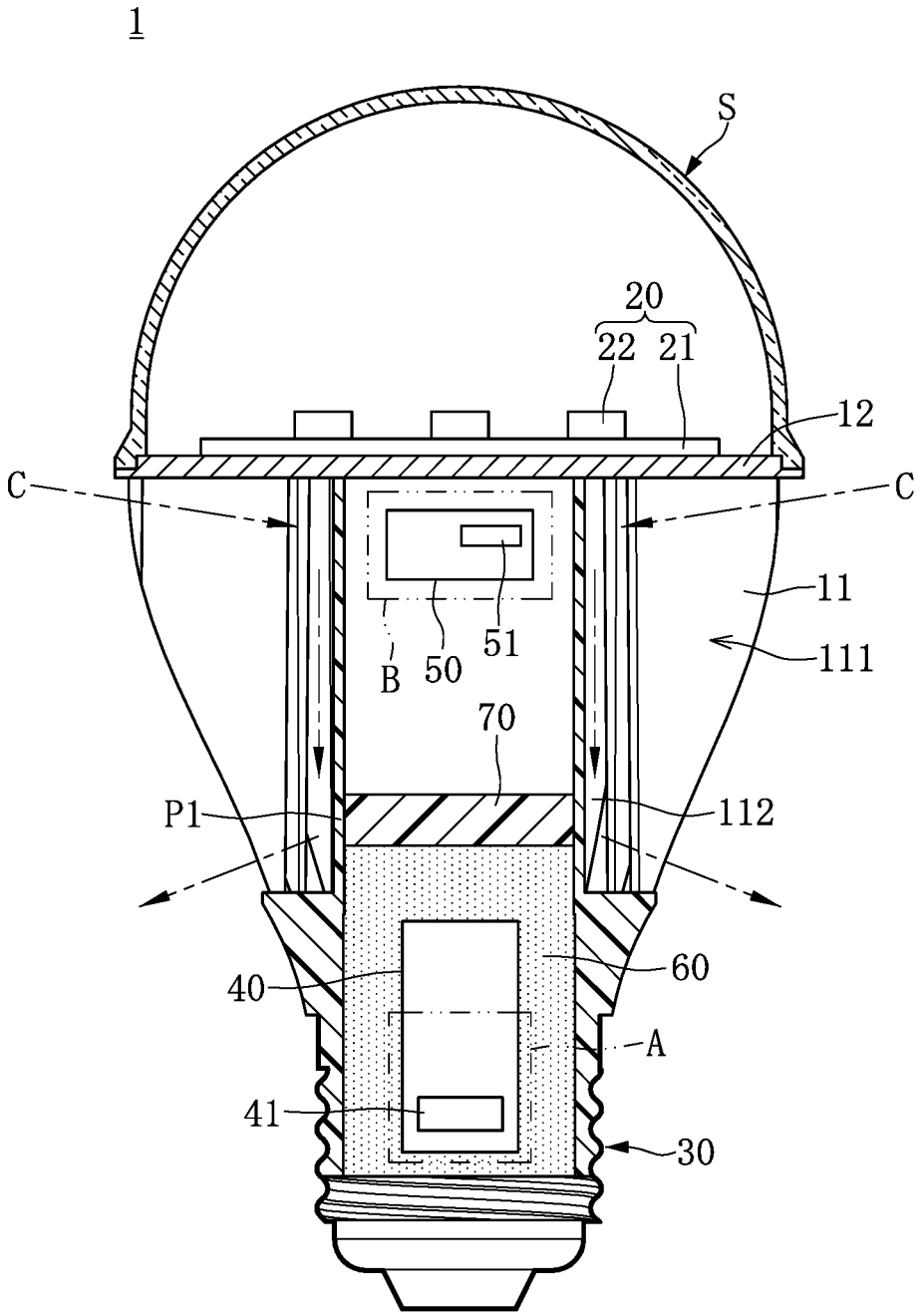
FIG. 11 shows a cross-sectional view of a lamp having the thermal sensing elements disposed at optimal positions according to an eighth embodiment of the instant disclosure.

Please refer to FIG. 11, the significant difference between the present embodiment and aforementioned ones is, in the preferred application, in addition to the aforementioned sealant 60 encapsulating the outside of the power source module 40 to reduce the ambient temperature of the thermal sensitive element 41 of the power source module 40, a thermal insulating element 70 (e.g. insulation cotton, heat resistant cotton, and insulation ceramics, etc.) is also disposed between the light-emitting module 20 and the sealant 60 of the power source module 40 to block the heat produced by the light-emitting module 20 from transmitting to the power source module 40. In the practical application, it could be full of the thermal insulating element 70 around the light-emitting module 20 and the sealant 60 when using the thermal insulating element 70 such as insulating cotton.

It is noted that, please refer to FIGS. 10 and 11, the range of the sealant filled in the hollow tube P1 could embrace the whole lamp cold zone A but exclude the lamp heat zone B; and the thermal insulating element 70 could be disposed between the lamp heat zone B and the sealant 60, or fill the whole area not filled with the sealant 60.

First Embodiment of the Method

Figure 12:
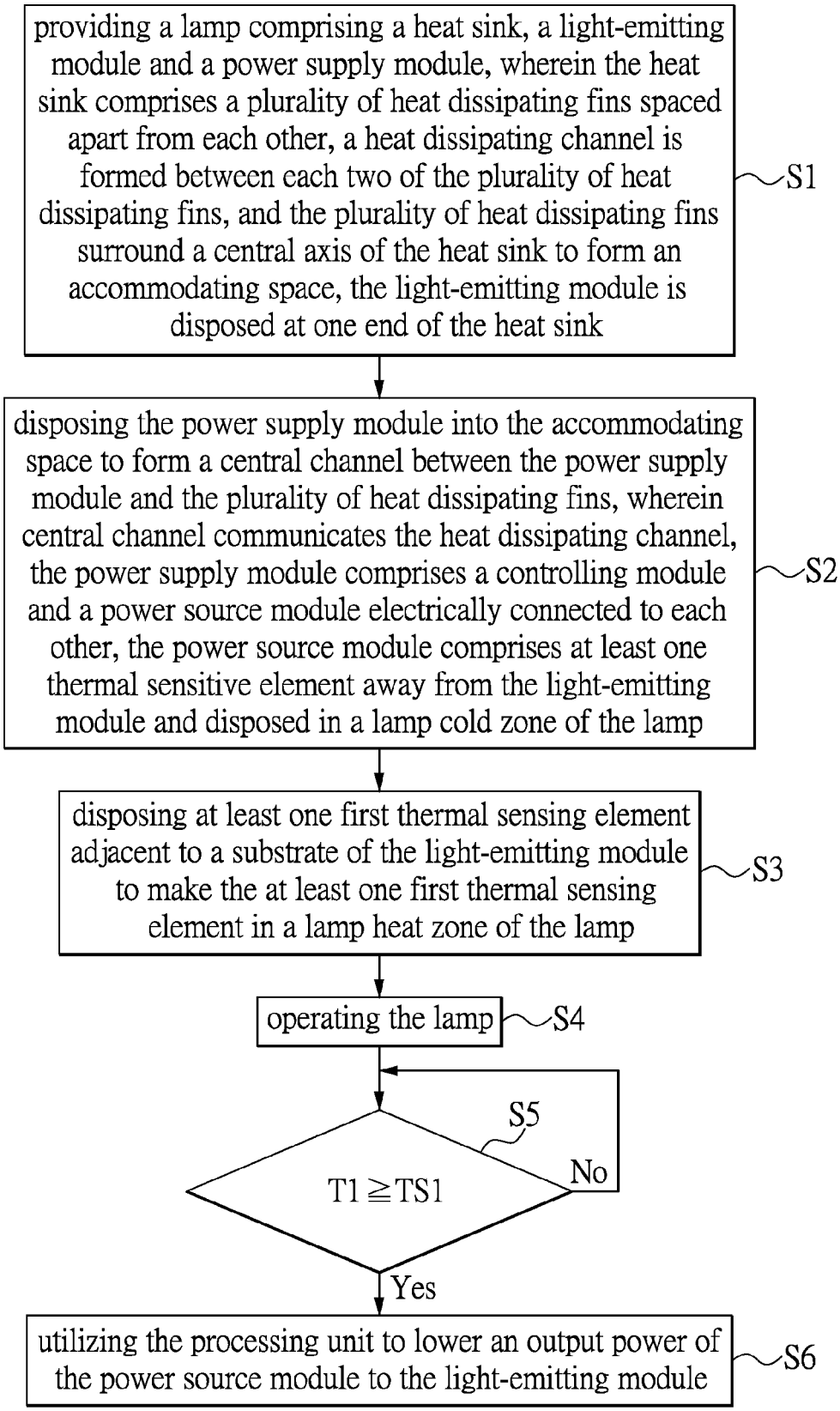
FIG. 12 shows a flow diagram of a thermal controlling method for lamps according to a first embodiment of the instant disclosure.

Please refer to FIG. 12, which is a flow diagram of a thermal controlling method for lamps according to a first embodiment of the instant disclosure. As shown in FIG. 12, the thermal controlling method for lamps comprises following steps:

step S1: providing a lamp comprising a heat sink, a light-emitting module and a power supply module, wherein the heat sink comprises a plurality of heat dissipating fins spaced apart from each other, a heat dissipating channel is formed between each two of the plurality of heat dissipating fins, and the plurality of heat dissipating fins surround a central axis of the heat sink to form an accommodating space, the light-emitting module is disposed at one end of the heat sink;

step S2: disposing the power supply module into the accommodating space to form a central channel between the power supply module and the plurality of heat dissipating fins, wherein the central channel communicates with the heat dissipating channel, the power supply module comprises a controlling module and a power source module electrically connected to each other, the controlling module comprises at least one first thermal sensing element and a processing unit electrically connected to the power source module and the at least one first thermal sensing element, the power source module comprises at least one thermal sensitive element away from the light-emitting module and disposed in a lamp cold zone of the lamp;

step S3: disposing the at least one first thermal sensing element adjacent to a substrate of the light-emitting module to make the at least one first thermal sensing element in a lamp heat zone of the lamp;

step S4: operating the lamp;

step S5: determining whether a first operating temperature T1 of the at least one first thermal sensing element is greater than or equal to a first critical operating temperature TS1 of the light-emitting module by utilizing the processing unit; performing step 6 when the processing unit determines that the first operating temperature T1 is greater than or equal to the first critical operating temperature TS1, otherwise, repeating performing the step 5; and step S6: utilizing the processing unit to lower an output power of the power source module to the light-emitting module.

Wherein, the said first thermal sensing element is disposed in the lamp heat zone of the lamp, and for the definition regarding the boundaries of the lamp cold zone and the lamp heat zone refers to the aforementioned embodiments. The above mentioned first critical operating temperature could be the endurable maximum temperature of the light-emitting unit during operation; the practical application of the first critical operating temperature could be designed to be slightly lower than the highest temperature to prevent the light-emitting unit from damage.

Second Embodiment of the Method

Figure 13:
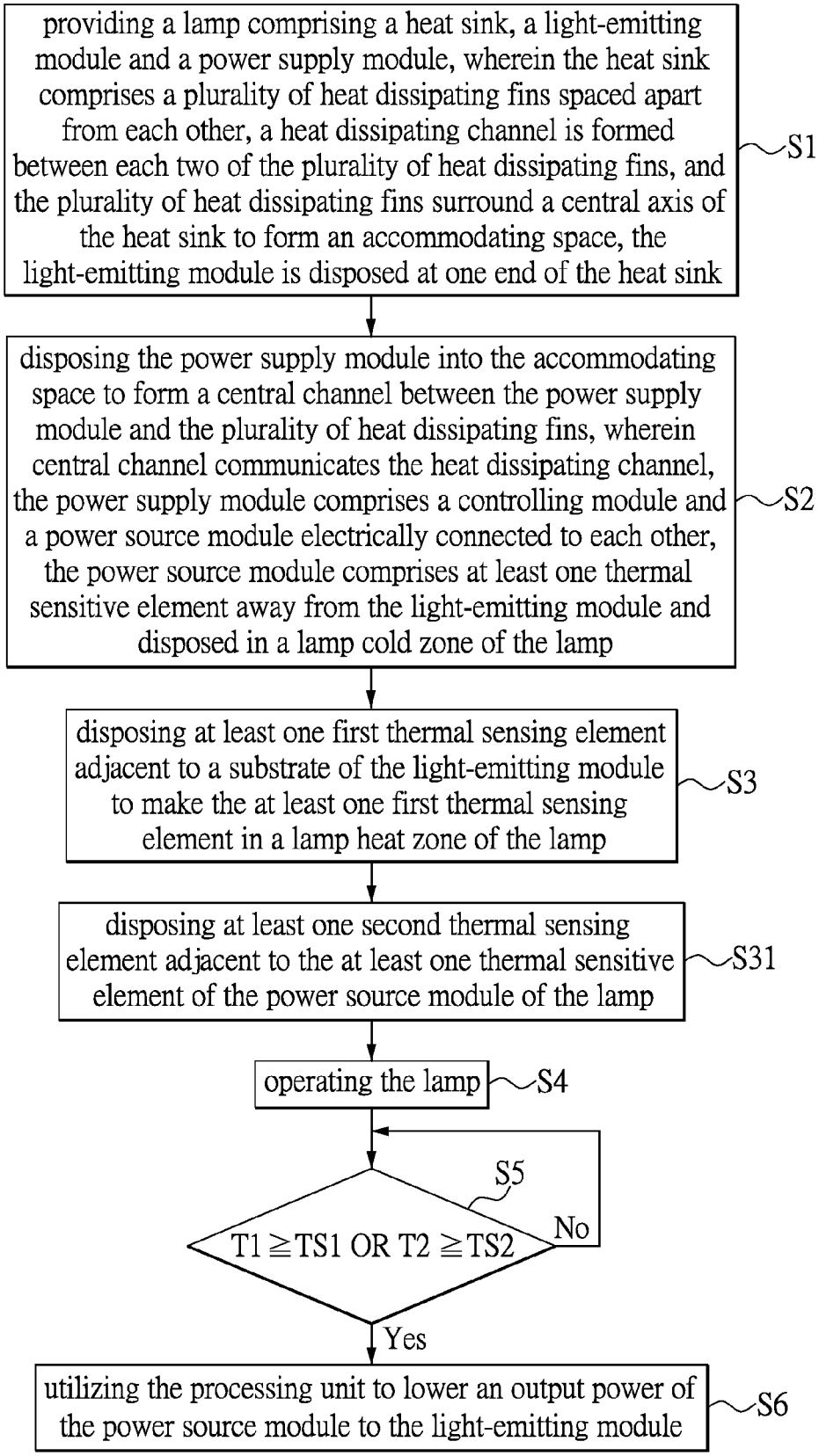
FIG. 13 shows a flow diagram of a thermal controlling method for lamps according to a second embodiment of the instant disclosure.

Please refer to FIG. 13, which is a flow diagram of a thermal controlling method for lamps according to a second embodiment of the instant disclosure. The difference between the present embodiment and the aforementioned embodiment is that the controlling module 50 further comprises at least one second thermal sensing element, and the second sensing thermal sensing element is electrically connected to the second thermal sensing element. The present embodiment further comprises the following steps: (steps 1 to 3 are the same as the aforementioned embodiment):

step S31: disposing the at least one second thermal sensing element electrically connected to the processing unit in the lamp and adjacent to the at least one thermal sensitive element of the power source module of the lamp;

step S4: operating the lamp;

step S5: determining whether a first operating temperature T1 of the at least one first thermal sensing element is greater than or equal to a first critical operating temperature TS1 of the light-emitting module, or a second operating temperature T2 of the at least one second thermal sensing element T2 is greater than or equal to a second critical operating temperature TS2 of the thermal sensitive element 41 by utilizing the processing unit; performing step 6 when the processing unit determines that the first operating temperature T1 is greater than or equal to the first critical operating temperature TS1, or the second operating temperature is greater than or equal to the second critical operating temperature, otherwise, repeating performing the step 5; and step S6: utilizing the processing unit to lower an output power of the power source module to the light-emitting module.

Wherein, the said first thermal sensing element and the said second thermal sensing element are disposed in the lamp heat zone and the lamp cold zone of the lamp, respectively, and for the definition regarding the boundaries of the lamp cold zone and the lamp heat zone refers to aforementioned embodiments. The above mentioned first critical operating temperature could be the endurable maximum temperature of the light-emitting unit during operating; the practical application of the first critical operating temperature could be designed to slightly lower than the highest temperature to prevent the light-emitting unit from damage. Different thermal sensitive elements can endure different maximum temperatures during operation, and the second critical operating temperature could be slightly lower than the minimal value among endurable maximum temperatures of each thermal sensitive element, and the second critical operating temperature could be designed according to each thermal sensitive element in the better exemplary embodiment. Specifically, in the better practical application, the additional first thermal sensing element and the second thermal sensing element could be disposed, therefore, even if one first thermal sensing element or one second thermal sensing element is damaged, the processing unit is still able to perform the determination of critical operating temperature according to other first thermal sensing elements or other second thermal sensing elements, which means that the processing unit determines the critical operating temperature according to the maximum temperature or the sub-maximum temperature among multiple first sensing elements (or second sensing elements). This is to prevent misjudging the temperature due to the damage of the thermal sensing elements.

Third Embodiment of the Method

Figure 14:
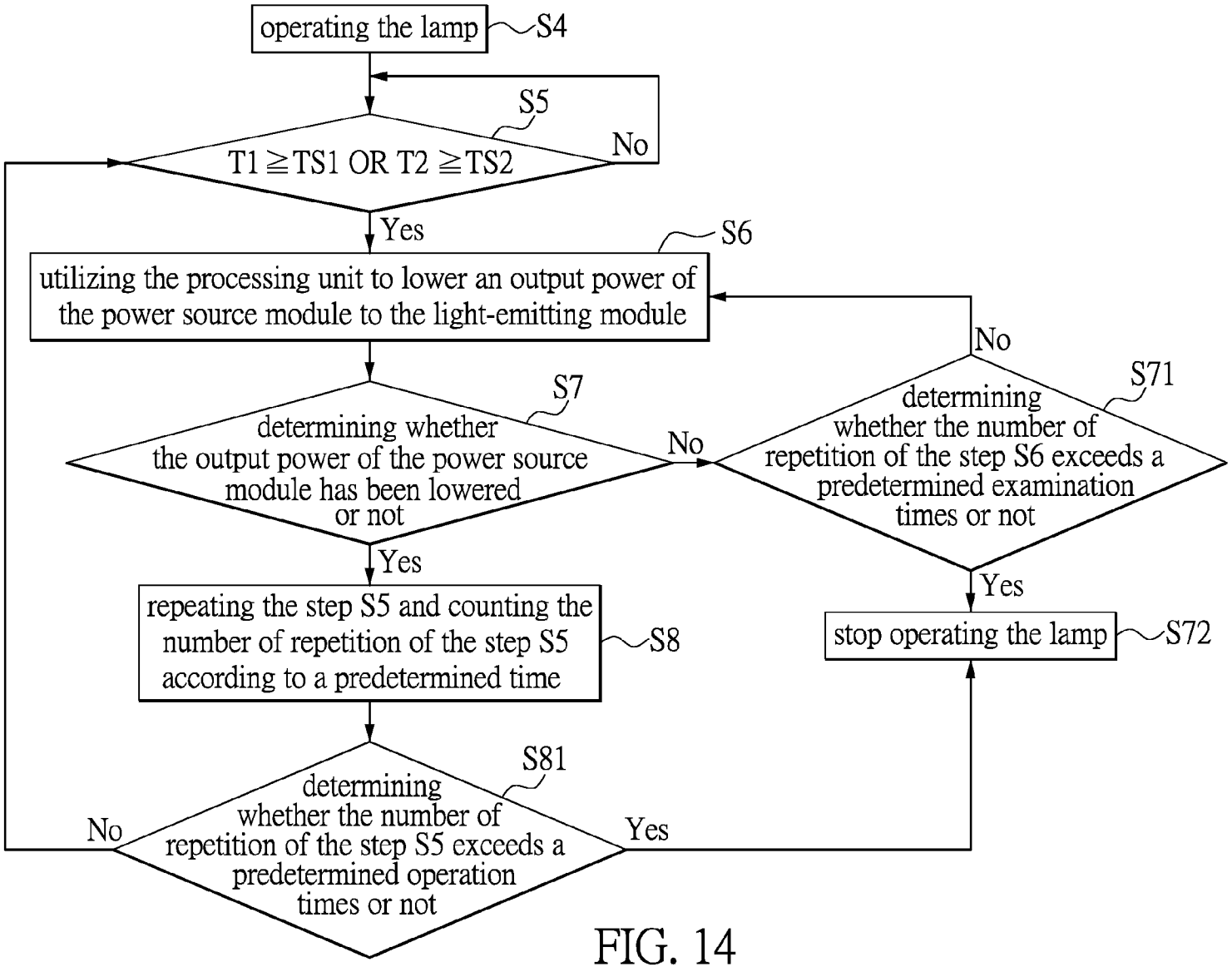
FIG. 14 shows a flow diagram of a thermal controlling method for lamps according to a third embodiment of the instant disclosure.

Please refer to FIG. 14, which is a flow diagram of a thermal controlling method for lamps according to a third embodiment of the instant disclosure. The difference between the present embodiment and the aforementioned embodiment is that the present embodiment further comprises the following steps (steps 1 to 6 are the same as the aforementioned embodiment):

step S7: determining whether the output power of the power source module has been lowered or not, if not, then performing step S8;

step S71: determining whether the number of repetition of the step S6 exceeds a predetermined examination times or not, if it exceeds, then performing the step S72; otherwise performing the step S6;

step S72: stop operating the lamp;

step S8: repeating the step S5 and counting the number of repetitions of the step S5 according to a predetermined time;

step S81: determining whether the number of repetitions of the step S5 exceeds a predetermined operation times or not, if it exceeds, then performing the step S72.

Wherein, the steps S7 to S72 used to make sure the operation for lowering the output power of the power source module have been performed, thereby preventing the damage of lamps due to the damage of the processing unit or the power source module and the overheating of the lamp. In addition, preferably the said steps S7 to S72 could be performed by an independent detection module, such that the said problem of the controlling module or the power source module could be effectively prevented.

Regarding steps S8 to S81, they are to make sure the lamp would not be heated after lowering the output power. If the lamp keeps heating, then the lamp will be stop operating. More specifically, after the processing unit lowers the output power for a while, the light-emitting module is supposed to stop heating, however, if the substrate still keeping heating after several times of performing lowering the output power, this would mean that the lamp might be broken and unable controlling the heating. The lamp must stop operating at this time to prevent damage of the lamp. In addition to the said steps S7 to S72, which could be performed by another independent detection module, steps S8 to S81 repeats monitoring temperatures and adjusting power by managing their own controlling module.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A lamp having thermal sensing elements disposed at optimal positions in which a lamp cold zone and a lamp heat zone are defined, comprising:

a heat sink, having a plurality of heat dissipating fins spaced apart from each other and a connecting part, wherein a heat dissipating channel is formed between each two of the plurality of heat dissipating fins, and the plurality of heat dissipating fins surround a central axis of the heat sink to form an accommodating space;

a light-emitting module, having a substrate and at least one light-emitting unit, wherein the substrate is disposed at the connecting part of the heat sink, and the at least one light-emitting unit is disposed on the substrate;

a power supply module, disposed in the accommodating space, wherein a central channel is formed between the power supply module and the plurality of heat dissipating fins, the central channel communicates with the heat dissipating channel, and the power supply module comprises:

a conductive base, disposed away from the substrate so as to connect an external power supply; and a power source module, electrically connected to the conductive base and the light-emitting module, wherein the power source module comprises at least one thermal sensitive element disposed at the lamp cold zone; and a controlling module, comprising at least one first thermal sensing element and a processing unit, wherein the at least one first thermal sensing element is disposed adjacent to the substrate in the lamp heat zone, the at least one first thermal sensing element senses a first operating temperature, and the processing unit is electrically connected to the power source module and the at least one first thermal sensing element; and wherein the processing unit lowers an output power of the power source module to the light-emitting module when the first operating temperature is greater than or equal to a first critical operating temperature of the light-emitting module, wherein, the lamp cold zone has a first cold zone boundary and a second cold zone boundary, the lamp heat zone has a first heat zone boundary and a second heat zone boundary; the first heat zone boundary is coplanar with a surface of the substrate on which the at least one light-emitting unit is disposed, the first cold zone boundary is at the bottom of the conductive base, and a distance between the first cold zone boundary and the first heat zone boundary is an internal element distance; a first distance between the second heat zone boundary and the first heat zone boundary is one-third of the internal element distance, and a second distance between the second cold zone boundary and the first cold zone boundary is one-third of the internal element distance.

2. The lamp according to claim 1, wherein the first thermal sensing element is disposed at the same side or the opposite side of the surface of the substrate on which the at least one light-emitting unit is disposed.

3. The lamp according to claim 2, wherein the first thermal sensing element is disposed in the heat sink and to be a safety distance from the substrate.

4. The lamp according to claim 3, wherein the safety distance is 0-7 mm.

5. The lamp according to claim 1, wherein the at least one first thermal sensing element is disposed on an extending circuit or an extending circuit board, and the extending circuit or the extending circuit board is at the lamp heat zone.

6. The lamp according to claim 1, wherein the controlling module further comprises at least one second thermal sensing element electrically connected to the processing unit, and the at least one second thermal sensing element is disposed adjacently to the at least one thermal sensitive element for sensing a second operating temperature with which the processing unit compares a second critical operating temperature of the at least one thermal sensitive element; the processing unit lowers the output power of the power source module to the light-emitting module when the first operating temperature is greater than or equal to the first critical operating temperature or when the second operating temperature is greater than or equal to the second critical operating temperature.

7. The lamp according to claim 6, wherein the first critical operating temperature is greater than the second critical operating temperature.

8. The lamp according to claim 1, wherein the at least one first thermal sensing element and the processing unit are connected by jump wires.

9. The lamp according to claim 1, wherein the outside of the power source module is encapsulated by a sealant, which is insulating paste or thermally conductive paste.

10. The lamp according to claim 9, wherein a thermal insulating element is disposed between the substrate of the light-emitting module and the sealant, and the thermal insulating element is electrically insulating.

11. A lamp having thermal sensing elements disposed at optimal positions in which a lamp cold zone and a lamp heat zone are defined, comprising:

a heat sink, having a plurality of heat dissipating fins spaced apart from each other and a connecting part, wherein a heat dissipating channel is formed between each two of the plurality of heat dissipating fins, and the plurality of heat dissipating fins surround a central axis of the heat sink to form an accommodating space;

a light-emitting module, having a substrate and at least one light-emitting unit, wherein the substrate is disposed at the connecting part of the heat sink, and the at least one light-emitting unit is disposed on the substrate;

a power supply module, disposed in the accommodating space, wherein a central channel is formed between the power supply module and the plurality of heat dissipating fins, the central channel communicates the heat dissipating channel, and the power supply module comprises:

a conductive base, disposed away from the substrate so as to connect an external power supply; and a power source module, electrically connected to the conductive base and the light-emitting module, wherein the power source module comprises at least one thermal sensitive element disposed at the lamp cold zone; and a controlling module, comprising at least one first thermal sensing element and a processing unit, wherein the at least one first thermal sensing element is disposed adjacent to the substrate in the lamp heat zone, the at least one first thermal sensing element senses a first operating temperature, and the processing unit is electrically connected to the power source module and the at least one first thermal sensing element; and wherein the processing unit lowers an output power of the power source module to the light-emitting module when the first operating temperature is greater than or equal to a first critical operating temperature of the light-emitting module, wherein, the lamp cold zone has a first cold zone boundary and a second cold zone boundary, the lamp heat zone has a first heat zone boundary and a second heat zone boundary; the first heat zone boundary is a safety distance toward to the conductive base from a surface of the substrate on which the at least one light-emitting element is disposed, the first cold zone boundary is at the bottom of the conductive base, and a distance between the first cold zone boundary and the first heat zone boundary is an internal element distance; a first distance between the second heat zone boundary and the first heat zone boundary is one-third of the internal element distance, and a second distance between the second cold zone boundary and the first cold zone boundary is one-third of the internal element distance.

12. The lamp according to claim 11, wherein the safety distance is 0-7 mm.

13. The lamp according to claim 11, wherein the at least one first thermal sensing element is disposed on an extending circuit or an extending circuit board, and the extending circuit or the extending circuit board is at the lamp heat zone.

14. The lamp according to claim 11, wherein the controlling module further comprises at least one second thermal sensing element electrically connected to the processing unit, and the at least one second thermal sensing element is disposed adjacent to the at least one thermal sensitive element for sensing a second operating temperature; the processing unit lowers the output power of the power source module to the light-emitting module when the first operating temperature is greater than or equal to the first critical operating temperature or when the second operating temperature is greater than or equal to the second critical operating temperature.

15. The lamp according to claim 14, wherein the first critical operating temperature is greater than the second critical operating temperature.

16. The lamp according to claim 11, wherein the at least one first thermal sensing element and the processing unit are connected by jump wires.

17. The lamp according to claim 11, wherein the outside of the power source module is encapsulated by a sealant, which is insulating paste or thermally conductive paste.

18. The lamp according to claim 17, wherein a thermal insulating element is disposed between the substrate of the light-emitting module and the sealant, and the thermal insulating element is electrically insulating.

19. A thermal controlling method for lamps, which comprises the following steps:

step S1: providing a lamp comprising a heat sink, a light-emitting module and a power supply module, wherein the heat sink comprises a plurality of heat dissipating fins spaced apart from each other, a heat dissipating channel is formed between each two of the plurality of heat dissipating fins, and the plurality of heat dissipating fins surround a central axis of the heat sink to form an accommodating space, the light-emitting module is disposed at one end of the heat sink;

step S2: disposing the power supply module into the accommodating space to form a central channel between the power supply module and the plurality of heat dissipating fins, wherein central channel communicates the heat dissipating channel, the power supply module comprises a controlling module and a power source module electrically connected to each other, the controlling module comprises at least one first thermal sensing element and a processing unit electrically connected to the power source module and the at least one first thermal sensing element, the power source module comprises at least one thermal sensitive element away from the light-emitting module and disposed in a lamp cold zone of the lamp;

step S3: disposing the at least one first thermal sensing element adjacent to a substrate of the light-emitting module to make the at least one first thermal sensing element in a lamp heat zone of the lamp;

step S4: operating the lamp;

step S5: determining whether a first operating temperature of the at least one first thermal sensing element is greater than or equal to a first critical operating temperature of the light-emitting module by utilizing the processing unit;

step S6: utilizing the processing unit to lower an output power of the power source module to the light-emitting module after the processing unit determined the first operating temperature is greater than or equal to the first critical operating temperature;

wherein, the lamp cold zone has a first cold zone boundary and a second cold zone boundary, the lamp heat zone has a first heat zone boundary and a second heat zone boundary; the first heat zone boundary is coplanar with a surface of the substrate on which the at least one light-emitting unit is disposed, the first cold zone boundary is at the bottom of the conductive base, and a distance between the first cold zone boundary and the first heat zone boundary is an internal element distance; a first distance between the second heat zone boundary and the first heat zone boundary is one-third of the internal element distance, and a second distance between the second cold zone boundary and the first cold zone boundary is one-third of the internal element distance.

20. The method according to claim 19, wherein the controlling module further comprises at least one second thermal sensing element electrically connected to the processing unit and further comprises the following step S31: disposing the at least one second thermal sensing element in the lamp and adjacent to the at least one thermal sensitive element of the power source module of the lamp, wherein the at least one first thermal sensing element is disposed at the same side or the opposite side of the surface of the substrate on which at least one light-emitting unit is disposed.

21. The method according to claim 20, wherein the step S5 further comprises the following step: determining whether a second operating temperature of the at least one second thermal sensing element is greater than or equal to a second critical operating temperature of the light-emitting module by utilizing the processing unit.

22. The method according to claim 21, wherein the first critical operating temperature is greater than the second critical operating temperature.

23. The method according to claim 19, wherein the first thermal sensing element is disposed in the lamp and a safety distance from the surface of the substrate on which the at least one light-emitting unit is disposed in the lamp, the safety distance is 0~7 mm, the first distance between the first heat zone boundary and the second heat zone boundary is within 0~20 mm, and the second distance between the first cold zone boundary and the second cold zone boundary is within 0~20 mm.

24. The method according to claim 19, further comprising following steps:

step S7: determining whether the output power of the power source module has been lowered or not, if not, then repeating step S6 and counting the number of repetition of the step S6; otherwise, performing step S8;

step S71: determining whether the number of repetition of the step S6 exceeds a predetermined examination times or not, if it exceeds, then performing the step S72; otherwise performing the step S6;

step S72: making the lamp stop operating;

step S8: repeating the step S5 and counting the number of repetition of the step S5 according to a predetermined time;

step S81: determining whether the number of repetitions of the step S5 exceeds a predetermined operation times or not, if it exceeds, then performing the step S72.

25. A thermal controlling method for lamps, which comprises following steps:

step S1: providing a lamp comprising a heat sink, a light-emitting module and a power supply module, wherein the heat sink comprises a plurality of heat dissipating fins spaced apart from each other, a heat dissipating channel is formed between each two of the plurality of heat dissipating fins, and the plurality of heat dissipating fins surround a central axis of the heat sink to form an accommodating space, the light-emitting module is disposed at one end of the heat sink;

step S2: disposing the power supply module into the accommodating space to form a central channel between the power supply module and the plurality of heat dissipating fins, wherein central channel communicates with the heat dissipating channel, the power supply module comprises a controlling module and a power source module electrically connected to each other, the controlling module comprises at least one first thermal sensing element and a processing unit electrically connected to the power source module and the at least one first thermal sensing element, the power source module comprises at least one thermal sensitive element away from the light-emitting module and disposed in a lamp cold zone of the lamp;

step S3: disposing the at least one first thermal sensing element adjacent to a substrate of the light-emitting module to make the at least one first thermal sensing element in a lamp heat zone of the lamp;

step S4: operating the lamp;

step S5: determining whether a first operating temperature of the at least one first thermal sensing element is greater than or equal to a first critical operating temperature of the light-emitting module by utilizing the processing unit;

step S6: utilizing the processing unit to lower an output power of the power source module to the light-emitting module after the processing unit determines the first operating temperature is greater than or equal to the first critical operating temperature;

wherein, the lamp cold zone has a first cold zone boundary and a second cold zone boundary, the lamp heat zone has a first heat zone boundary and a second heat zone boundary; the first heat zone boundary is a safety distance from the substrate, the first cold zone boundary is at the bottom of the conductive base, and a distance between the first cold zone boundary and the first heat zone boundary is an internal element distance; a first distance between the second heat zone boundary and the first heat zone boundary is one-third of the internal element distance, and a second distance between the second cold zone boundary and the first cold zone boundary is one-third of the internal element distance.

26. The method according to claim 25, wherein the controlling module further comprises at least one second thermal sensing element electrically connected to the processing unit and further comprises the following step S31: disposing the at least one second thermal sensing element in the lamp and adjacent to the at least one thermal sensitive element of the power source module of the lamp.

27. The method according to claim 26, wherein the step S5 further comprises the following step: determining whether a second operating temperature of the at least one second thermal sensing element is greater than or equal to a second critical operating temperature of the light-emitting module by utilizing the processing unit.

28. The method according to claim 26, wherein the first critical operating temperature is greater than the second critical operating temperature.

29. The method according to claim 25, wherein the safety distance is 0~7 mm, the first distance between the first heat zone boundary and the second heat zone boundary is within 0~20 mm, and the second distance between the first cold zone boundary and the second cold zone boundary is within 0~20 mm.

30. The method according to claim 25, further comprising following steps:

step S7: determining whether the output power of the power source module has been lowered or not, if not, then repeating step S6 and counting the number of repetitions of the step S6; otherwise, performing step S8;

step S71: determining whether the number of repetitions of the step S6 exceeds a predetermined examination times or not, if it exceeds, then performing the step S72; otherwise performing the step S6;

step S72: making the lamp stop operating;

step S8: repeating the step S5 and counting the number of repetitions of the step S5 according to a predetermined time;

step S81: determining whether the number of repetitions of the step S5 exceeds a predetermined operation times or not, if it exceeds, then performing the step S72.

* * * * *